US005518800A

United States Patent [19]

Okawa et al.

[11] Patent Number: 5,518,800

[45] Date of Patent: May 21, 1996

[54] GRAINED ARTIFICIAL LEATHER, PROCESS FOR MAKING SAME AND FABRICATED ARTICLES

[75] Inventors: Nobuo Okawa, Hiroshima; Yoshiyuki Suzuki, Ooda; Kunihiko Sasaki, Gotsu, all of Japan

[73] Assignee: Teijin Limited, Osaka, Japan

[21] Appl. No.: 284,661

[22] PCT Filed: Mar. 10, 1994

[86] PCT No.: PCT/JP94/00388

§ 371 Date: Aug. 18, 1994

§ 102(e) Date: Aug. 18, 1994

[87] PCT Pub. No.: WO94/20665

PCT Pub. Date: Sep. 15, 1994

[30] Foreign Application Priority Data

Mar. 10, 1993 [JP] Japan ..... 5-074995
Apr. 1, 1993 [JP] Japan ..... 5-096459

[51] Int. Cl.[6] ..... B32B 9/00

[52] U.S. Cl. ..... 428/151; 428/105; 428/114; 428/218; 428/286; 428/287; 428/288; 428/290; 428/295; 428/304.4; 428/311.1; 428/334; 428/337; 428/904

[58] Field of Search ..... 428/151, 218, 428/286, 287, 288, 290, 334, 337, 904, 295, 304.4, 105, 311.1, 114

[56] References Cited

U.S. PATENT DOCUMENTS 3,770,481 11/1973 Canat ..... 117/10
3,968,293 7/1976 Cunningham et al. ..... 428/213
3,982,335 9/1976 Cunningham et al. ..... 36/45
4,190,572 2/1980 Nishimura et al. ..... 264/46.4
4,434,205 2/1984 Fujii et al. ..... 428/218
4,515,852 5/1985 Katabe et al. ..... 428/246

FOREIGN PATENT DOCUMENTS 0310037 4/1989 European Pat. Off. .

*Primary Examiner*—Patrick J. Ryan
*Assistant Examiner*—Abraham Bahta
*Attorney, Agent, or Firm*—Armstrong, Westerman, Hattori, McLeland & Naughton

[57] ABSTRACT

A grained artificial leather comprised of a sheet-form fibrous base, a porous polyurethane layer having interconnected open cells, formed on at least one surface of the base, and a non-porous polyurethane film formed on the porous polyurethane layer. A multiplicity of open cells are interspersed in the porous polyurethane layer, part of which are closed by the non-porous polyurethane film and the remainder of which are not closed and at least 70% in number of the non-closed opening cells have a diameter of 1–25 μm.

The artificial leather is made by adhering the porous polyurethane layer to the sheet-form fibrous base, applying a polyurethane/solvent mixed liquid as dots interspersed on the surface of the polyurethane layer to develop a multiplicity of open cells on the surface, and then applying a finishing polyurethane on the open cell-developed surface.

26 Claims, 1 Drawing Sheet

GRAINED ARTIFICIAL LEATHER, PROCESS FOR MAKING SAME AND FABRICATED ARTICLES

TECHNICAL FIELD

This invention relates to a grained artificial leather, and a process for making the same. This grained artificial leather has good air permeability and water vapor permeability, and exhibits surface smoothness, stain resistance and abrasion resistance, which are improved over those of conventional grained artificial leather. This invention also relates to fabricated articles such as shoes, gloves, a chair and clothes, which have in at least part thereof the grained artificial leather.

BACKGROUND ART

Artificial leathers composed of a fibrous sheet and a high polymeric elastomer have come into general use as essential leather substitutes in many fields such as shoe uppers, auxiliary materials for shoes and clothes. These artificial leathers are classified into three types according to the surface configuration: a suede type, a nubuk type and a grain type. Of these, a suede type and a nubuk type can have good air permeability and water vapor permeability. But, since a grain type has a finishing non-porous surface layer composed of a synthetic resin, the air permeability and vapor permeability are not satisfactory. Especially, shoe uppers and clothes fabricated from a grained artificial leather exhibit an undesirably large stuffiness in wear, and thus, it is desired to reduce the stuffiness.

To solve the above-mentioned problem, an attempt has been made to mechanically needle the grained artificial leather for imparting an air permeability to reduce the stuffiness. This problem is solved when the needle apertures are large enough for the intended reduction of stuffiness, but another problem arises in that fine dusts enter the apertures and thus the leather is stained and the appearance of the leather becomes poor. When the needle apertures are small enough for avoiding staining due to fine dusts, the water vapor permeability is not satisfactory.

A proposal of forming a finishing polyurethane film on a base composed of a mixture of fibers and a high polymeric elastomer has been made to provide an artificial leather having discontinuous film characteristics. The artificial leather also has surface apertures having a large diameter and thus is stained, and the fibrous texture is not completely concealed by the finishing film and develops on the outer surface. Thus the artificial leather does not have a smooth surface nor an attractive appearance. Further the artificial leather does not have a porous polyurethane layer and therefore the abrasion resistance is poor.

In Japanese Unexamined Patent Publication No. 59-116479, a process has been proposed wherein a surface of a base composed of fibers or a mixture of fibers and a high polymer is coated with a high polymer solution; the coated solution is dried to a minor extent; a releasable support having a surface with a multiplicity of fine projections is pressed against the coated surface; the coated surface is dried; and then the releasable support is released, whereby the coated surface is converted into a grained surface having a multiplicity of fine open cells. The grained surface layer is directly formed on the fibrous base of the resulting grained artificial leather, and therefore when the leather is drawn, the fibrous texture of the base readily develops on the grained surface. Further, the leather does not have a porous polyurethane layer, and therefore, the cushioning properties and the abrasion strength are poor.

It is proposed in Japanese Unexamined Patent Publication No. 3-79643 to provide an artificial leather having good air permeability and water vapor permeability by forming a finishing porous polyurethane film on a base composed of fibers from a W/O emulsion of polyurethane. The resulting artificial leather has the porous finishing polyurethane film as the outermost surface layer, and thus, the abrasion resistance and mechanical strengths are poor as compared with those of artificial leathers having a non-porous polyurethane surface layer. Further, it is required that open cells are stably formed on the surface of the wet porous polyurethane layer, but the formation of the open cells on the resulting artificial leather as conducted on an industrial scale is not stable. The handling of a W/O emulsion is very restricted from viewpoints of pot life and spreadability, and a high technique is required. Therefore, the proposed process has not been practically employed. Further, when a polyurethane resin is used for the formation of a porous film in the proposed process utilizing a W/O emulsion, the as-formed film shrinks to a large extent when the as-formed film is dried to evaporate the solvent. Thus, the once-formed open cells are contracted and the formation of open cells of a desired size is difficult and restricted depending upon the environmental conditions.

To avoid the restriction for the formation of open cells, it has been proposed in Japanese Patent Publication No. 3-90684 that a porous layer is formed from a resin emulsion predominantly comprised of a poly-amino acid instead of the W/O emulsion. However, the proposed, process is costly and not advantageous form an industrial viewpoint.

It has been proposed in Japanese Unexamined Patent Publication No. 3-140320 that a porous film of a poly-amino acid urethane is formed on a base composed of fibers by using a phase-separation coagulation nucleating agent whereby an air-permeable artificial leather is obtained. This proposal also has problems such that the artificial leather has the porous finishing film as the outermost surface layer, and thus, the abrasion resistance and mechanical strengths are poor as compared with those of artificial leathers having a non-porous polymer surface layer. Further, it is required that open cells are stably formed on the surface of the wet porous polymer layer, but the formation of the open cells on the artificial leather is not stable. Further a poly-amino acid urethane is costly and not advantageous from an economical viewpoint.

DISCLOSURE OF THE INVENTION

An object of the present invention is to provide a grained artificial leather and fabricated articles thereof, which are characterized as exhibiting reduced stuffiness in wear, and having good stain resistance, smooth and attractive appearance, and good abrasion resistance.

In one aspect of the present invention, there is provided a grained artificial leather comprising a base comprised of an air-permeable sheet-form material composed of fibers and at least one polyurethane layer, which is firmly adhered onto a surface or the surfaces of the base and which has interconnected fine cells in the interior thereof and a multiplicity of open cells distributed in the surface layer portion thereof, characterized in that:

(A) a non-porous polyurethane film is formed on the surface of the porous polyurethane layer having interconnected fine cells in the interior thereof, (B) among the multiplicity of open cells distributed in the surface layer portion of the porous polyurethane layer, a part of the open cells are closed by the non-porous polyurethane film, and (C) the remainder part of the open cells are not closed by the non-porous polyurethane film and at least 70% in number of the remainder part of the open cells have a diameter of from 1 μm to 25 μm.

In the remainder part of the open cells in the grained artificial leather, the non-porous polyurethane film preferably spreads toward the interior of each open cell on the inner wall thereof without substantial clogging of the open space thereof whereby the open cells are narrowed.

In other aspects of the present invention, there are provided sports shoes and other shoes, the insteps of which are made of the above-mentioned grained artificial leather; gloves, the primary parts of which are made of the grained artificial leather; a chair, wherein either one or both of the back and the seat are made of the grained artificial leather; and a coat or other clothes, at least part of which is made of the grained artificial leather.

In still another aspect of the present invention, there is provided a process for making a grained artificial leather which comprises the steps of: (i) adhering a polyurethane layer having interconnected fine cells in the interior thereof, and not substantially having open cells on the surface thereof, to at least one surface of an air-permeable sheet-form base composed of fibers; (ii) applying a mixed liquid comprising polyurethane and a solvent selected from a good solvent, a poor solvent, a good solvent/poor solvent mixture and a good solvent/non-solvent mixture, as dots interspersed on the entire exposed surface of the polyurethane layer whereby a multiplicity of open cells are formed in the surface layer portion thereof; and then (iii) applying a finishing polyurethane onto the surface of the polyurethane layer whereby a non-porous polyurethane film is formed on the entire surface of the polyurethane layer.

In the above-mentioned process, the non-porous polyurethane film is preferably made to spread toward the interior of each open cell on the inner wall thereof without substantial clogging of the open cells whereby the open cells are narrowed, as well as the non-porous film is formed on the entire surface of the polyurethane layer.

BEST MODES FOR CARRYING OUT THE INVENTION

Figure 1:
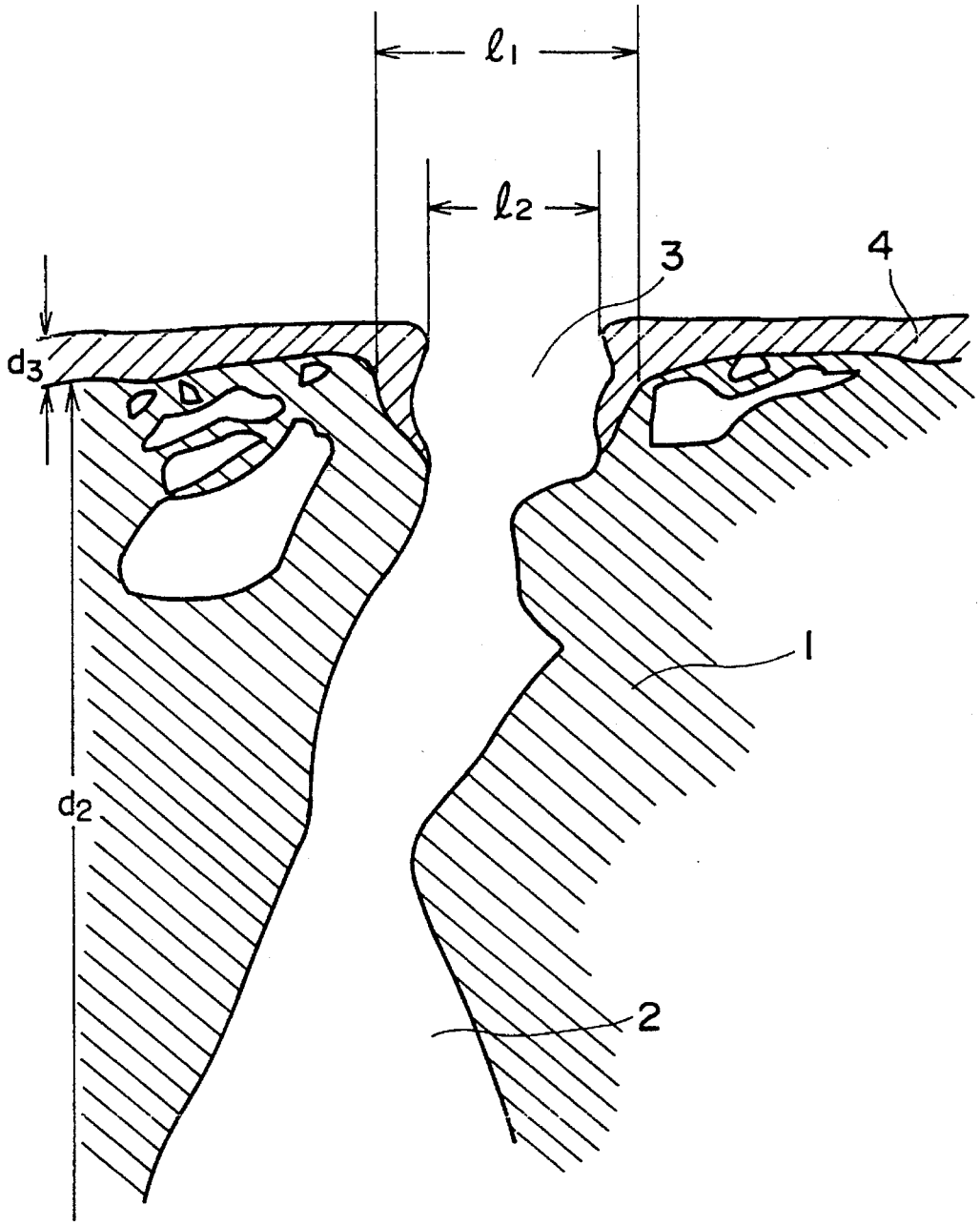
FIG. 1 is an enlarged cross-sectional view of a non-closed open cell-formed region in a porous polyurethane layer having interconnected fine cells and a non-porous polyurethane film.

As specific examples of the sheet-form material constituting the grained artificial leather of the present invention, there can be mentioned a woven fabric, a knitted fabric and a nonwoven fabric, which are composed of conventional natural fibers, regenerated fibers or synthetic fibers. To reduce the stuffiness of the artificial leather as felt in wear, the sheet-form material is preferably composed of moisture-absorbing fibers so that the backside of the artificial leather is rendered sweat-absorptive. Moisture-absorptive rayon fibers are suitable for this purpose. However, as a sheet-form material having high mechanical strengths is desired, fibers having high mechanical strengths are preferable such as a polyethylene terephthalate fiber or other polyester fibers or a polyamide fiber or polyester/polyamide mixed fibers. It is also preferable to use a combination of a fiber having high mechanical strengths with a rayon fiber. With regard to the form of the fibrous sheet-form material, a nonwoven fabric is preferable.

The base used in the present invention is comprised of the fibrous sheet-form material alone or of the fibrous sheet-form material plus a high polymer elastomer. As the high polymer elastomer, there can be mentioned those which have heretofore been used customarily as leather substitutes, such as polyurethane, polyurea, polyurethane-polyurea, a styrene-butadiene rubber and an acrylonitrile-butadiene rubber. Preferably these elastomers are used as an aqueous emulsion or a solvent solution for impregnating the fibrous sheet-form material therewith, and the aqueous emulsion or solution impregnated in the sheet-form material is coagulated whereby a base comprised of the fibrous sheet-form material and the high polymer elastomer is prepared.

The base preferably has a thickness of from 0.3 mm to 2.0 mm at a bulk density of from 0.2 to 0.6 g/cm$^3$.

A porous polyurethane layer having interconnected fine cells in the interior thereof is formed on at least one surface of a base comprised of the fibrous sheet-form alone or the fibrous sheet-form material plus the high polymer elastomer. As polyurethane used for the the preparation of the porous polyurethane layer, all of the known polyurethanes can be employed, and as the method of forming the porous polyurethane layer, all of the known conventional methods can be employed. For example, there can be mentioned a method wherein one surface of a base comprised of a fibrous sheet-form material alone or a fibrous sheet-form material plus a high polymer elastomer is coated with a solution of polyurethane in an organic solvent, and the coated base is placed in a coagulating bath which is a non-solvent for the polyurethane and is miscible with the organic solvent of the polyurethane solution used, whereby the polyurethane solution coated on the base is coagulated; and a method wherein one surface of a base comprised of a fibrous sheet-form material alone or a fibrous sheet-form material plus a high polymer elastomer is coated with a W/O type emulsion which is prepared by finely dispersing water in a solution or dispersion of polyurethane in an organic solvent, and the organic solvent is selectively evaporated from the the coated base whereby the polyurethane coating is coagulated.

The porous polyurethane layer having interconnected fine cells in the interior thereof has preferably a thickness of 0.03 mm to 0.6 mm, more preferably 0.1 to 0.2 mm to obtain good abrasion resistance, surface smoothness, cushioning properties and bulkiness. If the thickness is smaller than 0.03 mm, the texture of the fibrous sheet-form material is-not concealed and develops on the surface of the porous polyurethane layer, with the result of loss or reduction of surface smoothness. In contrast, if the thickness is larger than 0.6 mm, the artificial leather becomes rubber-like and the productivity is lowered.

To obtain a good air permeability, the porous polyurethane layer of the artificial leather which has interconnected fine cells in the interior thereof must have an open cell structure, i.e., must have open cells extending through the thickness of the base comprised of a fibrous sheet-form material alone or a fibrous sheet-form material plus a high polymeric elastomer, to the exposed surface of the porous polyurethane layer. In the above-mentioned prior art methods, the surface layer portion of the formed porous polyurethane is dense and, even if a small air permeability can be obtained, when a solution of a finishing polyurethane in a solvent is applied, the fine open cells on the surface disappear due to dissolution in the solvent or the fine open cells are clogged by the formed finishing polyurethane film. When a porous polyurethane layer is formed, it is possible to obtain open cells of a large diameter by using a porosity adjustor (i.e., coagulation adjustor). However, even if these open cells are obtained, when a finishing polyurethane is applied thereon, the air permeability is damaged in a manner similar to that in the prior art methods.

The main point of the process for making a grained artificial leather of the present invention lies in that open cells having an appropriate diameter are formed in the surface layer of a porous polyurethane layer prior to the formation of a finishing polyurethane film, the diameter of which is such that, when the finishing polyurethane film is formed, an appropriate air permeability is kept.

To surely develop cell apertures of a desired size on the surface of the porous polyurethane layer, a mixed liquid comprising polyurethane and a solvent selected from a good solvent, a poor solvent, a mixture of good solvent and a poor solvent and a mixture of a good solvent and a non-solvent is applied as interspersed dots.

The good solvent used herein means a solvent which is capable of dissolving therein the particular polyurethane used. As examples of the good solvent, there can be mentioned polar solvents such as dimethylformamide, tetrahydrofuran and dioxane, for polyurethane synthesized from an aromatic diisocyanate. The poor solvent used herein means a solvent which is incapable of dissolving therein but capable of swelling therewith the particular polyurethane used. As specific examples of the poor solvent, there can be mentioned ketones such as methyl ethyl ketone, alcohols such as isopropyl alcohol, and aromatic solvents such as toluene. The non-solvent used herein means a solvent which is incapable of dissolving therein nor swelling therewith the particular polyurethane used. A typical example of the non-solvent, there can be mentioned water.

By appropriately selecting a solvent, the solubility of the polyurethane used can be adjusted so as to develop open cells having a desired diameter. If a solvent exhibiting too strong dissolving power is used, open cells are once formed but the as-formed open cells are then undesirably closed in the step of evaporation of the solvent. In contrast, if a solvent exhibiting too weak dissolving power is used, open cells do not develop.

For applying the polyurethane/solvent mixed liquid in dots onto the surface of the porous polyurethane layer, a gravure mesh roll may be used. The mesh size of the gravure mesh roll greatly influences the diameter of the formed open cells. Namely, if a gravure mesh roll having a small mesh size is used, open cells having a relatively small diameter develop. If a gravure mesh roll having a large mesh size is used, open cells having a relatively large diameter develop. The gravure mesh roll preferably has a mesh size of from 70 to 200 mesh. The coating pressure of the gravure mesh roll also influences the diameter of the resulting open cells. Namely, the larger the coating pressure, the larger the open cell diameter, and the smaller the coating pressure, the smaller the open cell diameter. In general the gravure mesh roll is preferably used at a coating pressure of from 0.1 to 10 $kg/cm^2$. Thus by suitably selecting the kind of solvent, the mesh size of the gravure mesh roll and the coating pressure of the gravure mesh roll, open cells having a desired diameter, i.e., preferably 5 μm to 40 μm, more preferably 10 μm to 30 μm, are developed.

After open cells having a diameter of 5 μm to 40 μm are developed on the surface of the porous polyurethane layer having interconnected fine cells, a finishing polyurethane is applied thereon to form a finishing polyurethane film on the entire surface of the porous polyurethane layer having interconnected fine cells. A part of the open cells developed on the surface of the porous polyurethane layer are clogged by the finishing polyurethane film, but the remainder part of the cells are not clogged and remain substantially the same open state. It is important that at least 70% in number of the non-closed open cells has a diameter of from 1 μm to 25 μm. If the relative amount of non-closed open cells having a diameter smaller than 1 μm is large, the air permeability and water vapor permeability are reduced and the stuffiness increases. In contrast, if the relative amount of non-closed open cells having a diameter exceeding 25 μm is large, fine dusts are liable to enter the open cells, and the surface smoothness is injured and the refined appearance is lost.

In the non-closed open cells, it is preferable that the non-porous polyurethane film spreads on the inner wall of each open cell toward the interior thereof without substantial clogging of the open space thereof whereby narrowed open spaces are formed. FIG. 1 illustrates the state wherein the narrowed open cell is formed. Namely, an open cell 2 having a diameter of $l_1$ is formed in the surface layer of a porous polyurethane layer 1 having a thickness of $d_2$ and having interconnected fine cells in the interior thereof, and a non-porous polyurethane film 4 having a thickness $d_3$ is formed on the porous polyurethane layer 1. The non-porous polyurethane film 4 spreads over the shoulder of the open cell 3 and on the inner wall thereof toward the interior without substantial clogging of the open space thereof whereby a narrow open cell 3 having a diameter $l_2$ is formed.

Due to the formation of the narrow open cell, the abrasion resistance and durability as well as the stain resistance and surface smoothness are enhanced. Adequate narrow open cells are formed by suitably selecting the kind of solvent used for the preparation of a polyurethane solution, and the viscosity of the polyurethane solution.

The viscosity of the polyurethane solution for the non-porous polyurethane film greatly influences the coating amount on the inner wall of the open cells, and the spreading depth of the non-porous polyurethane into the porous polyurethane layer. The viscosity of a generally adopted gravure coating solution, i.e., a viscosity of 80 centipoise to 200 centipoise, preferably 10 centipoise to 140 centipoise is suitable for the formation of the above-mentioned narrow open cells.

As explained above, the kind of an organic solvent used for a solution for the formation of the non-porous polyurethane film greatly influences the diameter of the finally formed open cells. If a solvent having a too large dissolving power for the porous polyurethane layer having interconnected fine cells is used, the walls of the open cells once formed in the porous polyurethane layer are undesirably dissolved and the cell diameters are reduced. The smaller the dissolving power of the solvent, the less reduced the diameter of the open cells developed on the surface of the porous polyurethane layer. However, the solvent should have a dissolving power to an extent such that a good adhesion between the porous polyurethane layer having interconnected fine cells and the non-porous polyurethane film is obtained. In this respect, it is preferable to use a mixed solvent composed of a good solvent for the porous polyurethane and a poor or non-solvent for the porous polyurethane. As explained above, the diameter of the open cells of the porous polyurethane layer is reduced to some extent by the formation of the finishing non-porous polyurethane film. Therefore, in order to produce a grained artificial leather having open cells on the surface, at least 70% in number of which have a diameter of 1 μm to 25 μm, the open cells of the porous polyurethane layer before the formation of the non-porous polyurethane film should have a diameter of 5 μm to 40 μm.

Conventional coating methods can be employed for applying the finishing polyurethane solution, which include methods utilizing a gravure coater, a doctor knife coater and the like. The coating amount may be the same as that employed for the finishing film of the conventional artificial leather, i.e., in the range of 3 $g/m^2$ to 20 $g/cm^2$, preferably 5 $g/cm^2$ to 10 $g/cm^2$, as the solid content. The thickness of the finishing non-porous polyurethane film is preferably in the range of 0.001 mm to 0.002 mm.

It is preferable that the thickness ($d_1$) of the base, the thickness ($d_2$) of the porous polyurethane having interconnected fine cells and the thickness ($d_3$) of the non-porous polyurethane film satisfy the following formulae (1) and (2) in order to obtain a good balance between the feeling as felt typically when bent, and the processability.

$$20>d_1/d_2>1.0 \quad (1)$$

$$40>d_2/d_3>10 \quad (2)$$

Various auxiliaries can be incorporated in the finishing non-porous polyurethane film depending upon the intended use of the artificial leather. For example, a pigment or a dye can be incorporated to enhance the aesthetic effect. Further, since the grained artificial leather of the present invention has interconnected cells extending from the back to the upper surface, the leather has an air permeability and thus it is possible that, when the leather is used for shoe uppers or clothes, water such as rainwater penetrates the shoe uppers or clothes. Therefore, a water repellant should be incorporated in the finishing polyurethane film to impart water repellency to the leather. A permanent water repellency can be obtained by using a fluorine-modified polyurethane for the finishing polyurethane film and further using a water repellant. As an example of the water repellant, there can be mentioned Crysbon asister FX-3, supplied by Dainippon Ink and Chemicals Inc., which has a good compatibility with polyurethane. As examples of the fluorine-modified polyurethane, there can be mentioned Leatheroid FF4110 and FF4115, supplied by Dainichiseika Color & Chemicals Mfg. Co. As the water repellant, a silicone-modified polyurethane can also be used. Other auxiliaries for the finishing polyurethane film include, for example, an antioxidant, a mildewproofing agent and an ultraviolet light absorber.

Since the grained artificial leather of the present invention has a permeability to air and other gases such as $NO_x$ gases, it is possible that the polyurethane is discolored. Especially, the polyurethane constituting the porous polyurethane having interconnected fine cells is generally synthesized from an aromatic diisocyanate, and is readily discolored. Therefore, polyurethanes which are not readily discolored are preferably used for the finishing polyurethane. As examples of such polyurethanes, there can be mentioned those which are synthesized from an aliphatic diisocyanate such as 1,6-hexane diisocyanate and from an alicyclic diisocyanate such as isophorone diisocyanate or 4,4'-methylenebis(cyclohexyl isocyanate). In a preferred embodiment of the present invention, the polyurethane constituting the finishing polyurethane film is spread into open cells in the porous polyurethane layer and covers part of the inner wall of each open cell, and thus, discoloration of the leather can be prevented or minimized.

In order to impart an aesthetic effect to the surface of the grained artificial leather, any desired pattern can be formed by using an embossing roll, as generally carried out in the production of conventional artificial leathers. The embossing can be carried out before or after the development of open cells in the porous polyurethane layer, or during or after the formation of the finishing polyurethane film. However, when the embossing is carried out under heating, care should be taken because the polyurethane often melts and the open cells are liable to become small. Further, when the embossing is carried out before the development of open cells, care should be taken so that the surface dense layer portion of the porous polyurethane layer having interconnected fine cells does not become more dense and the development of open cells does not become difficult.

By the method described above, a grained artificial leather having open cells on the surface, at least 70% in number of which have a diameter have a diameter of from 1 μm to 25 μm, can be produced. If the diameter of the open cells is too small, the resistance against transmission of air is too large to attain the intended air permeability and water vapor permeability. In contrast, if the proportion of open cells having a diameter larger than 25 μm is too large, fabricated articles such as shoe uppers, shoe interiors and clothes stain easily when worn, and the stain enters in the open cells and will not easily be removed. Fine particles forming stain generally have a diameter of at least, approximately 30 μm.

The number of the open cells formed on the surface of the grained artificial leather of the present invention is preferably 100 to 3,000/$cm^2$, and more preferably 500 to 3,000/$cm^2$. The air permeability of the leather varies depending upon the particular diameter and number of the open cells, and therefore, when the diameter is small, the number should preferably be increased, and when the diameter is large, the number may be decreased. However, the water vapor permeability varies greatly depending upon the particular number of the open cells and the number of the open cells should generally be at least 100/$cm^2$. If the number of the open cells is too small, the desired water vapor permeability is difficult to obtain.

If the number of the open cells is too large, problems arise in stain resistance, abrasion resistance and other properties. Thus, the upper limit of the number of the open cells should be such that the total area of the open cells exposed on the surface is preferably not larger than 1% and more preferably in the range of 0.1% to 0.3%, based on the total surface area of the leather. If the total area of the open cells exposed on the surface exceeds 1%, the stain resistance and abrasion resistance are greatly reduced irrespective of the diameter and number of the open cells.

The grained artificial leather of the present invention preferably has an air permeability of from 0.5 liter/$cm^2$.hr to 35 liter/$cm^2$.hr and more preferably from 2 liter/$cm^2$.hr to 9 liter/$cm^2$.hr, and preferably has a water vapor permeability of 2.0 mg/$cm^2$.hr to 30 mg/$cm^2$.hr and more preferably 8 mg/$cm^2$.hr to 14 mg/$cm^2$.hr. If the air permeability and the water vapor permeability are too small, when used for fabricated articles such as shoes and clothes, these articles are stuffy similarly to conventional artificial leathers. If a grained artificial leather composed of a sheet-form fibrous base material and a high polymer elastomer layer has a special structure, it is possible that the leather does not have the desired air permeability and water vapor permeability. For example, if a dense layer of the high polymer elastomer is formed on the back side of the high polymer elastomer layer, the air permeability and the water vapor permeability become poor. Therefore, the formation of a dense elastomer layer should be avoided in the grained artificial leather of the present invention.

The invention will now be described by the following examples, wherein parts and % are by weight. The properties of the leather were determined as follows.

(1) Diameter, Number and Areal Ratio of Open Cells

The diameter, number and areal ratio of the open cells were measured by the observation of images obtained by using a scanning electron microscope (high precision image analyzing file system IP-1000, supplied by Asahi Kasei Kogyo K.K.).

(2) Air Permeability

The time required for passing 50 ml of air through a sample is measured by using Gurley's Densometer according to the method of JIS P8117, and the air permeability is expressed in "liter/cm$^2$.hr".

(3) Water Vapor Permeability

The water vapor permeability is measured by the method of JIS K6549 and expressed in "mg/cm$^2$.hr".

(4) Stain Resistance

Cigarette's ash ("Mild Seven") is ground by a mortar, and is rubbed on a sample leather in a manner such that a circle having a diameter of 36 mm is repeatedly drawn twenty-five times in the clockwise direction by the middle finger and further drawn twenty-five times in the counterclockwise direction by the middle finger. Then the ash is rubbed off by absorbent cotton, and the stain is evaluated and expressed by the five ratings from 1 to 5. The rating 5 means that the stain is not found.

EXAMPLE 1

Preparation of Base-1 Having a Porous Polyurethane Layer

A nonwoven fabric composed of polyester fibers and having a weight of 330 kg/m$^2$ and a thickness of 1.0 mm was impregnated with a solution of polyester polyurethane (synthesized from p,p'-diphenylmethane diisocyanate) in dimethylformamide having a concentration of 13%. One surface of the impregnated nonwoven fabric was coated with 650 g/m$^2$ of a solution of the same polyurethane as used for the above-mentioned impregnation in dimethylformamide having a concentration of 18%. The coated nonwoven fabric was immersed in water to coagulate the coating, washed with water and then dried to obtain a base-1 having a porous polyurethane layer. The base-1 had a sheet-form fibrous layer having a thickness of 1 mm and a porous polyurethane layer having a thickness of 280 μm.

Development of Open Cells

The exposed surface of the porous polyurethane layer of base-1 was coated with a mixed liquid composed of 40% of methyl ethyl ketone and 60% of dimethylformamide at a coating pressure of 4 kg/cm$^2$ by using a gravure coater having a gravure mesh roll with a 110 mesh size, and the coated base-1 was dried. Observation of the surface of the porous polyurethane layer of base-1 by a scanning electron microscope revealed that a multiplicity of open cells having a diameter of approximately 30 μm were formed.

Formation of a Finishing Polyurethane Film

The exposed surface of the open cell-developed porous polyurethane layer of base-1 was coated with a coating solution-1 prepared according to the following recipe, by using a gravure coater having a gravure mesh roll with a 110 mesh size, and then dried.

| [Coating solution-1] | |
|---|---|
| Crisvon NY320, supplied by Dainippon Ink and Chemicals (DIC) | 100 parts |
| Houlac A5303, supplied by DIC | 30 parts |
| Houlac A1008 mat, supplied by DIC | 30 parts |
| Isopropyl alcohol | 50 parts |
| Methyl ethyl ketone | 40 parts |
| Dimethylformamide | 10 parts |

The coating/drying was repeated three times, and the coated base-1 was subjected to an embossing treatment under heating whereby a pattern imitating the grain of leather skin with pores was formed. Then the embossed surface was coated with a coating solution-2 prepared according to the following recipe, by using a gravure coater having a gravure mesh roll with a 110 mesh size, and dried to obtain an artificial leather-1.

| [Coating solution-2] | |
|---|---|
| Houlac A3454, supplied by DIC | 100 parts |
| Houlac A1008 mat, supplied by DIC | 20 parts |
| Isopropyl alcohol | 50 parts |
| Methyl ethyl ketone | 40 parts |
| Dimethylformamide | 10 parts |

The surface of artificial leather-1 was white and had about 1,700 open cells per cm$^2$ which had a diameter of about 13 μm. The inner wall of each open cell was covered by coating solution-1 and coating solution-2. The areal ratio of the total area of the open cells to the total area of the surface of artificial leather was 0.23%. Artificial leather-1 had good air permeability and water vapor permeability, which were comparable to those of the conventional grained artificial leathers, and exhibited a good stain resistance. Properties of leather-1 are shown in Table 1.

EXAMPLE 2

Preparation of Base-2 Having a Porous Polyurethane Layer

A nonwoven fabric having a weight of 300 g/m$^2$ and a thickness of 1.3 mm, and made of a mixed fiber comprising 75% of polyester/nylon-6 fibers prepared by splitting a dividable polyester/nylon-6 composite fiber wherein the polyester and nylon-6 ingredients were arranged alternately and adjacently to each other, and 25% of rayon fibers, was impregnated with a solution of a polyester-polyether polyurethane (synthesized from p,p'-diphenylmethane diisocyanate) in dimethylformamide having a concentration of 13%. One surface of the impregnated nonwoven fabric was coated with 400 g/m$^2$ of a solution of the same polyurethane as used for the above-impregnation in dimethylformamide having a concentration of 18%. The coated nonwoven fabric was immersed in water to coagulate the coating, washed with water and then dried to obtain a base-2 having a porous polyurethane layer. The base-2 had a sheet-form fibrous layer having a thickness of 1.3 mm and a porous polyurethane layer having a thickness of 210 μm.

Development of Open Cells

The exposed surface of the porous polyurethane layer of base-2 was coated with a mixed liquid composed of 30% of methyl ethyl ketone and 70% of dimethylformamide at a coating pressure of 3 kg/cm$^2$ by using a gravure coater having a gravure mesh roll with a 110 mesh size, and the coated base-2 was dried. Observation of the surface of the porous polyurethane layer of base-2 by a scanning electron microscope revealed that a multiplicity of open cells having a diameter of approximately 25 μm were formed.

Formation of a Finishing Polyurethane Film

The exposed surface of the open cell-developed porous polyurethane layer of base-2 was coated with a coating solution-3 prepared according to the following recipe, by using a gravure coater having a gravure mesh roll with a 110 mesh size, and then dried.

| [Coating solution-3] | |
|---|---|
| Crisvon NY320, supplied by DIC | 100 parts |
| Houlac A5303, supplied by DIC | 30 parts |
| Houlac A1008 mat, supplied by DIC | 30 parts |
| Crisvon-assistor FX-3 (water-repellant), supplied by DIC | 2 parts |
| Isopropyl alcohol | 50 parts |
| Methyl ethyl ketone | 40 parts |
| Dimethylformamide | 10 parts |

The coating/drying was repeated twice, and the coated base-2 was further coated with a coating solution-4 prepared. according to the following recipe, by using a gravure coater having a gravure mesh roll with a 110 mesh size, and dried. The coating/drying was repeated twice, and the coated base-2 was subjected to an embossing treatment under heating whereby an artificial leather-2 having a pattern imitating the grain of leather skin with fine wrinkles was obtained.

| [Coating solution-4] | |
|---|---|
| Houlac A3454, supplied by DIC | 100 parts |
| Houlac A1008 mat, supplied by DIC | 20 parts |
| Crisvon-assistor FX-3 (water-repellant), supplied by DIC | 2 parts |
| Isopropyl alcohol | 50 parts |
| Methyl ethyl ketone | 40 parts |
| Dimethylformamide | 10 parts |

The surface of artificial leather-2 was white and had about 2,200 open cells per cm$^2$ which had a diameter of about 10 μm. The inner wall of each open cell was covered by coating solution-3 and coating solution-4. The areal ratio of the total area of the open cells to the total area of the surface of artificial leather was 0.17%. Artificial leather-2 had good air permeability and water vapor permeability, which were comparable to those of the conventional grained artificial leathers, and exhibited good stain resistance and water-repellency. Properties of leather-2 are shown in Table 1.

EXAMPLE 3

Development of Open Cells

The exposed surface of the open cell-undeveloped porous polyurethane layer of base-2 prepared in Example 2 was coated with a mixed liquid composed of 30% of methyl ethyl ketone and 70% of dimethylformamide at a coating pressure of 5 kg/cm$^2$ by using a gravure coater having a gravure mesh roll with a 200 mesh size, and the coated base-2 was dried to obtain a base-3. Observation of the surface of the porous polyurethane layer of base-3 by a scanning electron microscope revealed that a multiplicity of open cells having a diameter of approximately 15 μm were formed.

Formation of a Finishing Polyurethane Film

The exposed surface of the open cell-developed porous polyurethane layer of base-3 was coated with a coating solution-3 prepared in Example 2, by using a gravure coater having a gravure mesh roll with a 200 mesh size, and then dried. The coating/drying was repeated three times, and the coated base-3 was further coated with a coating solution-5 prepared according to the following recipe, by using a gravure coater having a gravure mesh roll with a 200 mesh size, and dried. The coating/drying was repeated twice and the coated base-3 was subjected to an embossing treatment under heating whereby an artificial leather-3 having a pattern imitating the grain of leather skin with fine wrinkles was obtained.

[Coating solution-5]

Leatheroid LU4180SF (fluorine-modified polyurethane, supplied by Dainichiseika Color and Chemicals Mfg. Co.) 100 parts Crisvon-assistor FX-3 (water-repellant, supplied by DIC) 2 parts The surface of artificial leather-3 was white and had about 3,100 open cells per cm$^2$ which had a diameter of about 7 μm. The inner wall of each open cell was covered by coating solution-3 and coating solution-5. The areal ratio of the total area of the open cells to the total area of the surface of artificial leather was 0.12%. Artificial leather-3 had good air permeability and water vapor permeability, which were comparable to those of the conventional grained artificial leathers, and exhibited good stain resistance and water-repellency. Properties of leather-3 are shown in Table 1.

EXAMPLE 4

The exposed surface of the open cell-developed porous polyurethane layer of base-2 prepared in Example 2 was coated with a coating solution-6 prepared according to the following recipe, by using a gravure coater having a gravure mesh roll with a 110 mesh size, and then dried.

| [Coating solution-6] | |
|---|---|
| Crisvon NY320, supplied by DIC | 100 parts |
| Houlac A5303, supplied by DIC | 30 parts |
| Houlac A1361, supplied by DIC | 2 parts |
| Houlac A1008 mat, supplied by DIC | 30 parts |
| Crisvon-assistor FX-3 (water-repellant), supplied by DIC | 2 parts |
| Isopropyl alcohol | 50 parts |
| Methyl ethyl ketone | 40 parts |
| Dimethylformamide | 10 parts |

The coating/drying was repeated twice, and the coated base-2 was further coated with a coating solution-4 prepared in Example 2, by using a gravure coater having a gravure mesh roll with a 110 mesh size, and dried. The coating/drying was repeated twice and the coated base-2 was subjected to an embossing treatment under heating whereby an artificial leather-4 having a pattern imitating the grain of leather skin with fine wrinkles was obtained.

The surface of artificial leather-4 exhibited a uniform gray color, although the porous polyurethane layer was colored white. The surface of artificial leather-4 had open cells which had the same configurations and approximately the same characteristics as those in artificial leather-2 prepared in Example 2. Properties of artificial leather-4 are shown in Table 1.

COMPARATIVE EXAMPLE 1

The exposed surface of the open cell-undeveloped porous polyurethane layer of base-1 prepared in Example 1 was coated with a coating solution-1 prepared in Example 1, by using a gravure coater having a gravure mesh roll with a 110 mesh size, and then dried. The coating/drying was repeated three times, and the coated base-1 was subjected to an embossing treatment under heating whereby a pattern imitating the grain of leather skin with pores was formed. Then the embossed surface was coated with a coating solution-2 prepared in Example 1, by using a gravure coater having a gravure mesh roll with a 110 mesh size, and dried to obtain an artificial leather-5.

The surface of artificial leather-5 was white and had an appearance similar to that of artificial leather-1 prepared in Example 1. However, observation of the surface by a scanning electron microscope revealed that there were no open cells. Artificial leather-5 exhibited no air permeability and exhibited a water vapor permeability which was similar to those of the conventional artificial leathers. The properties of artificial leather-5 are shown in Table 2.

COMPARATIVE EXAMPLE 2

The surface of artificial leather-5 made in Comparative Example 1 was subjected to a mechanical needling treatment to be thereby pierced with 9 holes per $cm^2$. Each hole had a diameter of 150 μm at the surface of the leather. The thus-prepared artificial leather-6 exhibited an air permeability but the water vapor permeability was approximately the same degree as those of the conventional artificial leathers. The artificial leather-6 was fabricated into shoe uppers. The shoes were easily stained and the stain was difficult to remove. The properties of the needled artificial leather-6 are shown in Table 2.

COMPARATIVE EXAMPLE 3

A nonwoven fabric composed of polyester fibers and having a weight of 330 $g/m^2$ and a thickness of 1.0 mm was impregnated with a solution of polyurethane in dimethylformamide by the same procedure as described in Example 1. One surface of the impregnated nonwoven fabric was coated with 90 $g/m^2$ of the same polyurethane solution in dimethylformamide as used in Example 1. The coated nonwoven fabric was immersed in water to coagulate the polyurethane coating, washed with water and then dried to prepare a base-3. The base-3 was composed of a sheet-form fibrous layer having a thickness of 1.0 mm and a porous polyurethane layer having a thickness of 38 μm. The base-3 was subjected to an open cell-developing treatment, a finishing polyurethane film-forming treatment and then an embossing treatment by the same procedures as those employed in Example 1, whereby an artificial leather-7 having a pattern imitating the grain of leather skin with pores was obtained.

The artificial leather-7 had open cells on the surface, the number and diameter of which were approximately the same as those of artificial leather-1 obtained in Example 1. The air permeability and the water vapor permeability of artificial leather-7 were similar to those of artificial leather-1. However, the surface of artificial leather-7 was rough and had a poor smoothness, and, when stretched, the fibrous texture of the sheet-form fibrous layer developed on the outer surface. Thus artificial leather-7 was of poor quality. The properties of artificial leather-7 are shown in Table 2.

COMPARATIVE EXAMPLE 4

The exposed surface of the open cell-undeveloped porous polyurethane layer of base-1 prepared in Example 1 was coated at a coating pressure of 4 $kg/cm^2$ with a mixed liquid composed of 50% of methyl ethyl ketone and 50% of dimethylformamide by using a gravure coater having a gravure mesh roll with a 70 mesh size, and then dried. Observation of the coated surface by a scanning electron microscope revealed that a multiplicity of open cells having a diameter of about 45 m were developed. The open cell-developed base-1 was subjected to a finishing polyurethane film-forming treatment and an embossing treatment by the same procedures as those employed in Example 1 whereby an artificial leather-8 was obtained.

Artificial leather-8 had about 850 open cells per $cm^2$ on the surface, which had a diameter of about 40 μm, and the areal ratio of the total area of the open cells to the total surface area was 1.07%. The air permeability and the water vapor permeability of artificial leather-8 were superior to those of the conventional artificial leathers as shown in Table 2, but artificial leather-8 was easily stained. Artificial leather-8 was fabricated into shoe uppers. The shoes were easily stained, and the stain was difficult to remove because the stain deeply penetrated in the open cells. Further the shoes were easily abraded, and the diameter of the open cells increased and the leather was increasingly stained with an increase of the wearing time.

EXAMPLE 5

The exposed surface of the open cell-undeveloped porous polyurethane layer of base-1 prepared in Example 1 was coated at a coating pressure of 4 $kg/cm^2$ with a mixed liquid composed of 50% of methyl ethyl ketone and 50% of dimethylformamide by using a gravure coater having a gravure mesh roll with a 200 mesh size and a mesh area ratio of 60%, and then dried. Observation of the coated surface by a scanning electron microscope revealed that a multiplicity of open cells having a diameter of about 15 μm were developed. The open cell-developed base-1 was subjected to a finishing polyurethane film-forming treatment and an embossing treatment by the same procedures as those employed in Example 1 whereby an artificial leather-9 was obtained.

Artificial leather-9 had about 630 open cells per $cm^2$ on the surface, which had a diameter of about 6 μm, and the areal ratio of the total area of the open cells to the total surface area was 0.02%. The air permeability and the water vapor permeability of artificial leather-9 were superior to those of the conventional artificial leathers, as shown in Table 1.

COMPARATIVE EXAMPLE 5

The exposed surface of the open cell-undeveloped porous polyurethane layer of base-1 prepared in Example 1 was coated at a coating pressure of 2 $kg/cm^2$ with a mixed liquid composed of 70% of methyl ethyl ketone and 30% of dimethylformamide by using a gravure coater having a gravure mesh roll with a 200 mesh size and a mesh area ratio of 60%, and then dried. Observation of the coated surface by a scanning electron microscope revealed that a multiplicity of open cells having a diameter of about 9 μm were developed. The open cell-developed base-1 was subjected to a finishing polyurethane film-forming treatment and an embossing treatment by the same procedures as those employed in Example 1 whereby an artificial leather-10 was obtained.

Artificial leather-10 had about 150 open cells per $cm^2$ on the surface, which had a diameter of about 3 μm, and the areal ratio of the total area of open cells to the total surface area was 0.001%. The air permeability and water vapor permeability of artificial leather-10 were 0.1 liter/$cm^2$.hr and 3.7 mg/$cm^2$.hr, respectively, as shown in Table 2. Artificial leather-10 was fabricated into shoe uppers. The shoes were stuffy in wear which was similar to the conventional artificial leathers.

TABLE 1

| | Examples | | | | |
|---|---|---|---|---|---|
| | 1 | 2 | 3 | 4 | 5 |
| Thickness of porous polyurethane layer (μm) | 280 | 210 | 210 | 210 | 280 |
| Diameter of open cells in surface (μm) | 13 | 10 | 7 | 10 | 6 |
| Number of open cells per $cm^2$ | 1,700 | 2,200 | 3,100 | 2,200 | 630 |
| Areal ratio of open cells to surface area (%) | 0.23 | 0.17 | 0.12 | 0.17 | 0.02 |
| Air permeability (liter/$cm^2$ · hr) | 4.1 | 3.5 | 3.3 | 3.5 | 0.9 |
| Water vapor permeability (mg/$cm^2$ · hr) | 10.7 | 11.2 | 11.6 | 11.1 | 6.7 |
| Stain resistance (Rating) | 5 | 5 | 5 | 5 | 5 |

TABLE 2

| | Comparative Examples | | | | |
|---|---|---|---|---|---|
| | 1 | 2 | 3 | 4 | 5 |
| Thickness of porous polyurethane layer (μm) | 280 | 280 | 38 | 280 | 280 |
| Diameter of open cells in surface (μm) | — | 150 | 14 | 45 | 3 |
| Number of open cells per $cm^2$ | — | 9 | 1,700 | 850 | 150 |
| Areal ratio of open cells to surface area (%) | — | 0.16 | 0.26 | 1.07 | 0.01 |
| Air permeability (liter/$cm^2$ · hr) | 0 | 2.6 | 4.2 | 4.0 | 0.1 |
| Water vapor permeability (mg/$cm^2$ · hr) | 2.3 | 2.4 | 10.5 | 7.5 | 3.7 |
| Stain resistance (Rating) | 5 | 1 | 5 | 3 | 5 |

EXAMPLE 6

Shoemaking and Wearing Test

The artificial leathers prepared in the above-mentioned examples and comparative examples were fabricated into shoe uppers, and, tennis sneakers were made from the shoe uppers.

Each pair of the tennis sneakers made from artificial leather-1 prepared in Example 1, artificial leather-2 prepared in Example 2, artificial leather-5 prepared in Comparative Example 1 and artificial leather-6 prepared in Comparative Example 2 were simultaneously put on both feet, and, after jogging was taken for 3 kilometers and further 10 minutes elapsed, the temperature and humidity inside the sneakers were measured in the worn state. This test was conducted by 10 persons and average values of the temperatures and humidities were calculated.

The results are shown in Table 3. As shown in Table 3, the temperatures and humidities of the sneakers in Examples 1 and 2 were, respectively, 1° C. lower and 5%–7% R.H. lower than those of the sneakers in Comparative Examples 1 and 2. The wearers could feel the difference in stuffiness between the sneakers of the invention and those of the comparative examples.

TABLE 3

| Time elapsed after jogging | | Shoes-1 (Ex. 1) | Shoes-2 (Ex. 2) | Shoes-5 (Com.1) | Shoes-6 (Com.2) |
|---|---|---|---|---|---|
| Immediately after | Temperature (°C.) | 33.3 | 33.3 | 33.4 | 33.4 |
| | Humidity (R.H. %) | 60 | 60 | 62 | 61 |

TABLE 3-continued

| Time elapsed after jogging | | Shoes-1 (Ex. 1) | Shoes-2 (Ex. 2) | Shoes-5 (Com.1) | Shoes-6 (Com.2) |
|---|---|---|---|---|---|
| 5 minutes | Temperature (°C.) | 34.0 | 33.9 | 34.4 | 34.5 |
| | Humidity (R.H. %) | 64 | 65 | 67 | 67 |
| 10 minutes | Temperature (°C.) | 33.5 | 33.4 | 34.5 | 34.4 |
| | Humidity (R.H. %) | 70 | 70 | 75 | 77 |
| 15 minutes | Temperature (°C.) | 33.0 | 32.9 | 33.8 | 33.9 |
| | Humidity (R.H. %) | 72 | 71 | 78 | 80 |
| 20 minutes | Temperature (°C.) | 32.6 | 32.4 | 33.7 | 33.8 |
| | Humidity (R.H. %) | 73 | 72 | 79 | 81 |

Industrial Applicability

The grained artificial leather of the present invention has good air permeability, water vapor permeability and stain resistance, and smooth surface and good appearance. Especially, a preferable grained artificial leather having narrowed open cells on the surface has further good abrasion resistance and durability as well as the above-mentioned properties.

Therefore, the grained artificial leather of the present invention is useful for uppers of shoes such as sport shoes, gloves, a seat and/or a back of chairs, coats and other clothes.

We claim:

1. A grained artificial leather comprising:

a) a base layer of an air-permeable sheet form fibrous material;

b) a layer of cellular porous polyurethane having its lower surface adhered to the base layer, said cellular porous polyurethane having interconnected cells in its interior and 100 to 3000/cm$^2$ of open cells on its upper surface, wherein at least 70% of the open cells have a diameter of 1 to 25 μm; and c) a film of a non-porous polyurethane on the upper surface of the non-porous layer, wherein the film of non-porous polyurethane extends into the open cells in the upper surface of the cellular porous polyurethane layer without clogging said open cells.

2. A grained artificial leather according to claim 1, wherein the base layer has a thickness of 0.3 mm to 2.0 mm and a bulk density of 0.2 to 0.6 g/cm$^3$.

3. A grained artificial leather according to claim 1, wherein the cellular porous polyurethane layer has a thickness of 0.03 mm to 0.6 mm.

4. A grained artificial leather according to claim 1, wherein the non-porous polyurethane film has a thickness of 0.001 mm to 0.02 mm.

5. A grained artificial leather according to claim 1, wherein the thickness ($d_1$) of the base, the thickness (d2) of the porous polyurethane layer and the thickness (d3) of the non-porous polyurethane film satisfy the formulas 20>d1/d2>1.0 and 40>d2/d3>10.

6. A grained artificial leather according to claim 1, wherein the base layer is a polyester nonwoven fabric, a nylon nonwoven fabric or a polyester/nylon mixed nonwoven fabric.

7. A grained artificial leather according to claim 1, wherein the non-porous polyurethane film is a water repellent film.

8. A grained artificial leather according to claim 7, wherein the water repellent film is made of a fluorine-modified polyurethane.

9. A grained artificial leather according to claim 7, wherein the water repellent film is made of a silicone-modified polyurethane.

10. A grained artificial leather according to claim 1, wherein the grained artificial leather has a permeability of from 0.5 liter/cm$^2$.hr to 30 mg/cm$^2$.hr.

11. A grained artificial leather according to claim 10, wherein the grained artificial leather has a water vapor permeability of from 2.0 mg/cm$^2$.hr to 30 mg/cm$^2$.hr.

12. A grained artificial leather according to claim 1, wherein the non-porous polyurethane film has an embossed surface.

13. A shoe having improved air permeability, reduced stuffiness and improved stain resistance, wherein the instep of the shoe is made of a grained artificial leather as described in claim 1.

14. A shoe according to claim 13 which is a sport shoe.

15. A glove having improved air permeability, reduced stuffiness and improved stain resistance comprising a grained artificial leather as described in claim 1.

16. A chair having improved air permeability, reduced stuffiness and improved stain resistance, wherein at least one of the back and the seat of the chair is made of a grained artificial leather as described in claim 1.

17. An article of clothing having improved air permeability, reduced stuffiness and improved stain resistance, at least a portion of which is made of a grained artificial leather as described in claim 1.

18. A process for making a grained artificial leather having from 100 to 3,000/cm$^2$ of open cells on its upper surface wherein at least 70% of the open cells have a diameter of 1 to 25 μm, which comprises:

forming a layer of a cellular porous polyurethane having interconnected cells in its interior on at least one surface of an air-permeable base sheet, said cellular porous polyurethane layer having substantially no open cells on its exposed surface;

applying a liquid comprising a solvent capable of dissolving the cellular porous polyurethane as dots interspersed on the entire exposed surface of the cellular porous polyurethane layer, whereby a multiplicity of open cells are formed in the surface layer portion thereof; and then applying a finishing polyurethane over the entire surface of the cellular polyurethane layer having open cells in the surface layer portion thereof, whereby a non-porous polyurethane film is formed on the entire surface of the cellular porous polyurethane layer extending into the open cells in the upper surface of the cellular porous polyurethane layer without clogging the open cells.

19. A process according to claim 18, wherein application of the liquid as dots is effected using a gravure mesh roll.

20. A process according to claim 19, wherein the gravure mesh roll has a mesh size in the range of from 70 to 200 mesh.

21. A process according to claim 20, wherein the gravure mesh roll is used at a coating pressure of 0.1 to 10 $kg/cm^2$.

22. A process according to claim 18, wherein the open cells formed in the surface layer portion of the porous polyurethane layer have a diameter of from 5 to 40 μm.

23. A process according to claim 18, wherein the solvent capable of dissolving the polyurethane additionally comprises a solvent incapable of dissolving the polyurethane but capable of swelling the polyurethane, a solvent incapable of dissolving the polyurethane but capable of swelling the polyurethane or a solvent incapable of dissolving or swelling the polyurethane.

24. A process according to claim 18, wherein the liquid comprises at least one solvent selected from the group consisting of toluene, methyl ethyl ketone, isopropyl alcohol and ethyl acetate.

25. A process according to claim 18, wherein the liquid has a viscosity of 80 to 200 centipoise.

26. A process according to claim 18, wherein the finishing polyurethane is applied in an amount of from 3 $g/m^2$ to 20 $g/m^2$ over the cellular polyurethane layer.

* * * * *